United States Patent [19]

Huffman

[11] 4,037,975

[45] July 26, 1977

[54] WRITING INSTRUMENT

[76] Inventor: Fred A. Huffman, P.O. Box 1319, Rawlins, Wyo. 82301

[21] Appl. No.: 683,198

[22] Filed: May 4, 1976

[51] Int. Cl.[2] ..... B43K 7/00

[52] U.S. Cl. ..... 401/6; 15/443

[58] Field of Search ..... 401/6, 7; D19/42; 15/437, 443; 40/37

[56] References Cited

U.S. PATENT DOCUMENTS

| | | | |
|---|---|---|---|
| 843,767 | 2/1907 | Plach | 15/443 |
| 878,004 | 2/1908 | Jahn | 15/443 |
| 1,438,114 | 12/1922 | Hume | 401/6 |
| 1,647,536 | 11/1927 | Miller | 401/6 X |
| 2,240,906 | 5/1941 | Harold | 40/37 |

*Primary Examiner*—Lawrence Charles
*Attorney, Agent, or Firm*—Clarence A. O'Brien; Harvey B. Jacobson

[57] ABSTRACT

A writing instrument of new and novel configuration in the shape of a bird, such as a duck, and the like. One end, preferably the head portion of the instrument which resembles the head of the bird has an index finger engaging portion opposite the point of the writing instrument for applying appropriate pressure thereto by a user's index finger. The upper, outermost portion of the head slants so as to permit a user's fingernail to extend over the front top of the head without interference. The lower central portion of said body of the bird-like device being shaped and/or mounted for convenient pivotal movement about the pivot point by the writer when using the device. The body of said instrument also has suitable surfaces for the user's thumb and remaining fingers when the user holds the instrument while writing. Posterior eraser means for removing written material is also provided.

11 Claims, 8 Drawing Figures

WRITING INSTRUMENT

BACKGROUND OF THE INVENTION

1. Field of the Invention

This invention relates generally to writing instruments and the shape and configuration thereof for the purpose of making the instrument both attractive as well as more functional.

2. Description of the Prior Art

A common problem with known type writing instruments is in the fact that they offer very little appeal to the user as an item of interest. An item of interest to the user often times is very important, especially in the case of children. In the case of children, an item which interests them and resembles some known animal, such as a bird, and the like, will appeal to such children and encourage them to use the writing instrument. Also, the shape and design of such instruments are important in order to be able to use such an instrument in a pleasant and handy manner. A basic writing instrument such as conventional pens and pencils, if considered honestly and objectively, are quite awkward instruments to use, and in themselves do not offer any direct pleasing sensation to the user.

Known prior art patents which may be pertinent to this invention are as follows:

U.S. Pat. No. Des. 43,242 — Nov. 12, 1912 — Bernstein

U.S. Pat. No. Des. 155,996 — Nov. 15, 1949 — Gowland

U.S. Pat. No. 1,411,691 — Apr. 4, 1922 — George

U.S. Pat. No. 2,296,139 — Sep. 15, 1942 — Blair U.S. Pat. No. 3,338,217 — Aug. 29, 1967 — Harrison.

None of these known prior art devices offers the new and unique features of the invention disclosed herein.

SUMMARY OF THE INVENTION

An object of the present invention is to provide a new and novel writing instrument having a configuration which resembles a known bird-like animal, such as a duck.

Another object of the present invention is to provide a writing instrument which has a body member with pivotal means provided at the bottom of said body member for permitting the user of the instrument to pivot the body about said pivot means to engage the head of the device with a material to be written thereupon.

A further object of this invention is to provide a writing instrument having a body portion with head means containing a writing point and a surface opposite said writing point on the other side of the head to receive or be pressured by the index finger of a user of the instrument. The head also slopes or slants in such a form that a user's fingernail, if long, may extend over the front portion of said head without interference. Appropriate body surfaces are also provided for engagement by the thumb and remaining fingers of the user's hand. Ribs may also be provided on some of these body surfaces for better gripping thereof.

A still further object of this invention is to provide a writing instrument in the shape of a bird-like creature which will be easily held in the hand of a user and will create a pleasant sensation to said user in order to increase interest in using the instrument.

A still further object of this invention is to provide a writing instrument having a bird-like body member and erasure means at the tail end of said bird-like member for the purpose of removing or deleting incorrect written information.

Another still further object of this invention is to provide a bird-like body member having a separate pivotable support at the lower portion of said body which will allow the instrument to pivot about said support point when in use and will also support said instrument in an erect position when the device is not in use.

The writing instrument of this invention offers a very pleasant and pleasing sensation to a user of same. The configuration is such that the body resembles a bird-like member, such as a duck, and the shape also is such that pressure may be appropriately applied to the head of the member opposite to the writing point for increasing the pressure. Also, the head is so shaped as to slant away in The index finger is normally the one used to apply this pressure. Aslo, the head is so shaped as to slant away in the front thereof to permit a user's fingernail, if long, to extend over the front of the head without contact therewith. Additional structure, such as recesses in the sides of the instrument provide convenient retention means for the thumb and remaining fingers of the user. Ribs may be provided in some or all of these recesses for better gripping action by the user.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
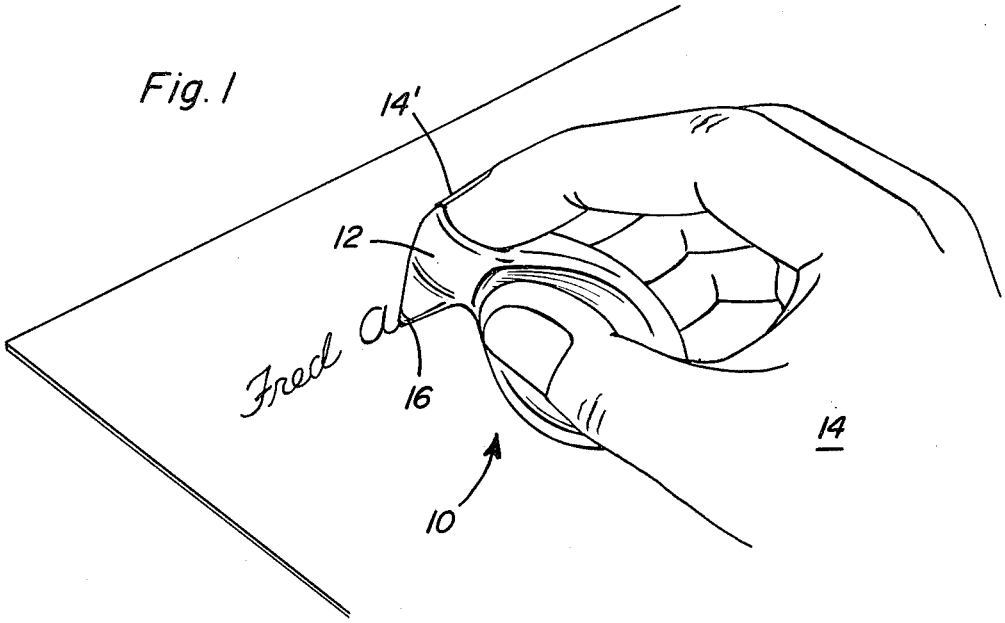
FIG. 1 is a perspective view of one embodiment of this invention.

FIG. 1 of the drawings shows the writing instrument of this invention being held in the hand of a user and is indicated in general by reference numeral 10. The body of the writing instrument is held between the thumb and fingers of a user's hand 14, with the index finger resting upon the head portion 22 opposite the marking point 16. The front of the head is cut away at 22' to permit a long fingernail 14' on a user's finger, as shown, to extend over the front of the head without contact therewith. FIGS. 2 through 6 show the various side and body configurations which are unique to the first embodiment of this writing instrument. Looking at FIGS. 2 and 4, the thumb receiving recess portion 20 may be clearly seen. Ribs or longitudinal projections 20' are also shown. Such ribs may be provided for all the recesses in the body in addition to recess 20, if desired.

Figure 2:
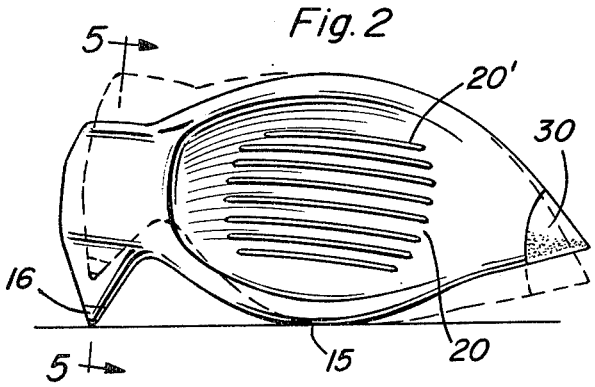
FIG. 2 is a left side elevational view of the device of this invention.
Figure 3:
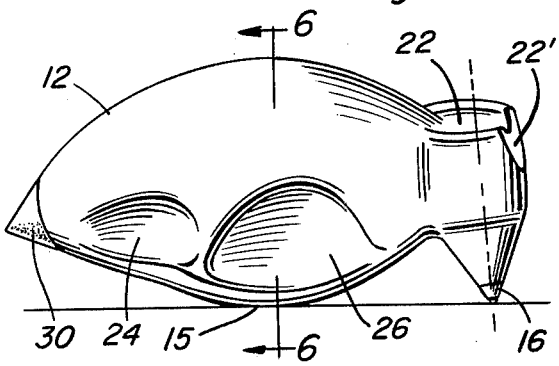
FIG. 3 is a right side elevational view of the device of this invention.

The pivot portion 15 at the lower bottom of the body 12 is clearly shown in FIGS. 2 and 3. When a user is writing with this instrument, said user may rock the body about the pivot point or pivot surface 15 to easily engage the writing point 16 with the surface of the paper or other material being written upon, and also rest one's entire hand while holding the instrument on this pivot surface 15. The head portion of this bird-like writing instrument has a recess 22 opposite the writing point 16 for receiving the user's index finger. This allows a natural resting point for one's index finger as well as providing a pressure point therefor. This pressure point together with the pivot surface 15 and the point 16 make an imaginary triangle such that any pressure applied by an index finger at the surface 22 will exert a magnified pressure on the point 16 for ease of writing and making of a legible impression therewith.

Figure 4:
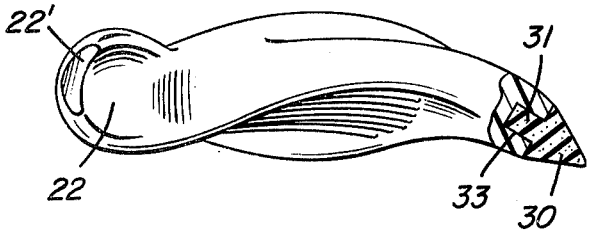
FIG. 4 is a top plan view of the device of this invention.
Figure 5:
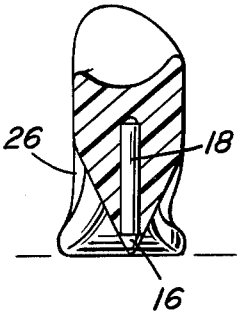
FIG. 5 is a view taken generally along line 5—5 of FIG. 2.
Figure 6:
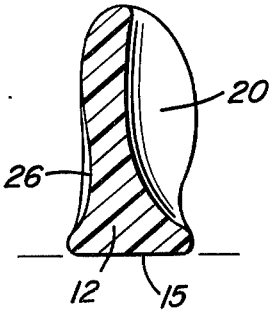
FIG. 6 is a view taken generally along line 6—6 of FIG. 3.

Looking at FIG. 3, the recesses 24 and 26 are provided for the fingers of the user's hand. FIG. 5 shows a cross-section through the head of the bird-like writing instrument and shows the mounting of the marking point 16 with a ball point ink supply 18 firmly embedded in an aperture provided in said head portion. FIG. 6, a cross-sectional view through the center portion or body portion of the writing instrument shows the length of the contact of the pivotal surface 15, together with the recesses 20 and 26. The tail of the bird has an erasing member 30 embedded therein, as best seen in FIG. 4, with a projecting member 31 fitting into an aperture 33 within the main body portion.

From the above description, it can be easily visualized how the writing instrument of this invention may be held between one's fingers and thumb and rotated about the pivot surface 15. Dotted lines in FIG. 2 indicate the raised or non-writing position of said writing instrument.

Figure 7:
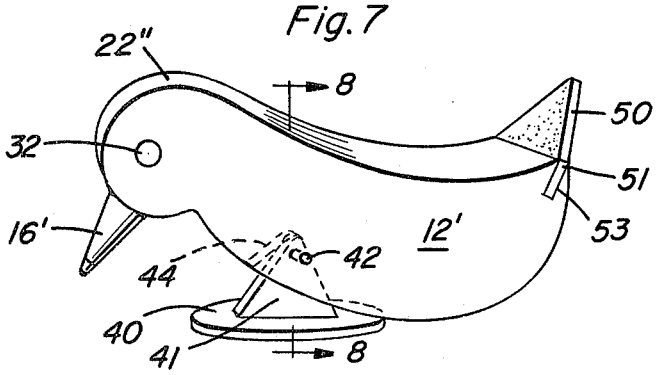
FIG. 7 is a perspective view of a modified embodiment of the device of this invention.
Figure 8:
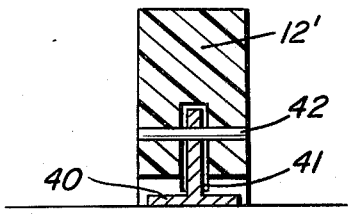
FIG. 8 is a view taken generally along line 8—8 of FIG. 7.

FIGS. 7 and 8 show another embodiment of this invention. Like reference numerals are applied to like portions of the device with a subscript added. A body member 12' is shown having an index finger head portion 22' and a writing or marking member 16' to represent the pointed beak of the bird-like body. As the head portion 22'' is rounded to slope away from a user's finger, a long fingernail on the finger will not contact the head in this version of the device either. In this embodiment instead of the pivot surface 15 as in the above embodiment, a pivot stand 40 having an upright pedestal 41 thereon is mounted between and within an aperture in the central body portion and secured therein with a pivot pin 42. A spring member 44 may be provided about said pivot pin to cause the bird-like body to remain in an upright position when at rest. When a user writes with this embodiment, the user will slide the instrument along the writing surface by moving the pedestal 40 therealong and then pivot the bird about pivot point 42 to engage the writing point 16' with the writing paper. The operation and use of this embodiment is very much like that of the preferred embodiment. The tail portion of this embodiment is also an eraser medium 50 shaped with a triangular pointed portion and an extending portion 51 for reception within a slot 53 at the tail end of the bird-like body.

As can be seen with both of these embodiments, a user can comfortably grip the writing instrument while in use and the user will have a pleasant and pleasing sensation through the sense of touch when using either instrument. This is especially important for the elderly and the young. Young people need to be encouraged to write properly and a writing instrument such as disclosed herein will aid greatly in accomplishing this. When a writing instrument is comfortable and easy to use, it is much more likely to be used. The two embodiments of writing instruments disclosed herein accomplish this purpose.

The writing instruments of this invention also have unique bird-like configurations which will be quite useful as novelty items in give-away packages and novelty hand-out type promotions.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A writing instrument comprising: a body element in the shape of a bird-like creature having holding means associated therewith so the body element can be easily held between the fingers of a user in a comfortable manner so as to create a pleasant sensation to the user while being held for performing writing; additional means for resting on a writing surface and permitting pivotal movement of said body on said surface, a marking structure at the head end of said body element to represent the beak of a bird, and further means for exerting a magnified pressure on the marking structure when a user pivots the body about said additional means resting on a writing surface.

2. The structure as set forth in claim 1, wherein the additional means includes a projecting rounded surface on the bottom portion of said body element.

3. The structure as set forth in claim 2, wherein the further means includes a relatively deep index finger receiving recess on the head portion of said bird-like body element for applying pressure at said point to the said marking structure, and the head portion has a sharply slanted portion at the front top thereof so a long fingernail on the index finger of a user when the finger is in the deep recess will not contact the head portion.

4. The structure as set forth in claim 3, wherein the holding means includes a thumb receiving recess on the side portion of the body element, and the thumb receiving recess being provided with thumb engageable ribs therealong to prevent slipping.

5. The structure as set forth in claim 4, wherein the holding means includes a first finger receiving recess on the side of the body oppsite to said thumb recess, and a second finger receiving recess provided slightly behind the first one.

6. The structure as set forth in claim 5, together with erasure means at the end of said body opposite to the marking structure and for the purpose of correcting errors in written material and to resemble a tail.

7. The structure as set forth in claim 1, wherein the first means for resting on a writing surface includes a pivot support stand for permitting the body element to pivot thereabout and also to support said body element in an erect bird-like position when the instrument is not being used, said pivot support stand having a single upright pedestal thereon, the upper end of the pedestal mounted within a central aperture in the body element, and a pivot pin securing the body to the pedestal for said pivotal movement.

8. The structure as set forth in claim 7, wherein the bird-like shape of the body element is in the form of a duck, and the marking structure at the end of the body element which represents the head of the duck resembles the bill of a duck, and a spring member provided about the pivot pin to cause the body element to remain in an upright position when the writing instrument is not being used.

9. The structure as set forth in claim 8, together with eraser means at the end of said body opposite the marking structure which is at the head of said bird-like body with said erasure means being at the tail end of said body.

10. A writing instrument in the shape of a bird comprising; body means so shaped as to form a pleasant hand engaging structure for convenient use by a writer, a writing implement at the beak position of the head of the bird-like instrument, a lower body portion means shaped so as to form a pivot point for rotating the bird-like body thereabout for convenient and pleasant use of said instrument, and further means of permitting a magnified pressure on the writing implement when the body means is rotated about said pivot point.

11. The structure as set forth in claim 10, wherein the said further means comprises the head portion of the bird-like body having an index finger receiving recess on said head portion of said body element for applying pressure at said point to the said writing element, and a slope to the front of said head so as not to interfere with a user's fingernail.

* * * * *